United States Patent [19]

Nemo

[11] Patent Number: 4,705,643

[45] Date of Patent: Nov. 10, 1987

[54] DETERGENT LUBRICANT COMPOSITIONS

[75] Inventor: Thomas E. Nemo, Naperville, Ill.

[73] Assignee: Standard Oil Company (Indiana), Chicago, Ill.

[21] Appl. No.: 646,131

[22] Filed: Aug. 30, 1984

[51] Int. Cl.[4] ..... C16M 129/00

[52] U.S. Cl. ..... 252/51.5 A

[58] Field of Search ..... 252/51.5 A

[56] References Cited

U.S. PATENT DOCUMENTS 3,110,673 11/1963 Benoit ..... 252/51.5 A 4,202,784 5/1980 Cahill et al. ..... 252/51.5 A

*Primary Examiner*—William R. Dixon, Jr.

*Assistant Examiner*—Cynthia A. Prezlock

*Attorney, Agent, or Firm*—William C. Clarke; William H. Magidson; Ralph C. Medhurst

[57] ABSTRACT

An ashless two-stroke cycle additive is prepared by condensing isostearic acid and tetraethylenepentamine. The additive maintains excellent engine cleanliness and has excellent low-temperature storage stability in a lubricant composition.

6 Claims, No Drawings

DETERGENT LUBRICANT COMPOSITIONS

FIELD OF THIS INVENTION

The field of this invention relates to novel lubricating oil compositions. More particularly, this invention relates to a two-stroke cycle internal combustion engine lubrication oil composition which contains an ashless two-stroke cycle additive which maintains excellent engine cleanliness and has excellent low temperature storage stability.

It is an object of this invention to provide a lubricant composition which provides improved cleanliness without contributing to spark plug fouling and destructive pre-ignition in a two-stroke cycle engine.

It is an object of this invention to provide a lubricant composition which provides improved cleanliness in a two-stroke cycle engine and has excellent low temperature storage stability.

It is a further object of this invention to provide an ashless additive for lubricant compositions which provides improved detergent characteristics to the lubricant compositions. It is a further object of this invention to provide an ashless detergent additive for lubricant compositions, which, when incorporated in a lubricant, has excellent low temperature storage stability.

These and other objects will become apparent from the description given hereafter.

BACKGROUND OF THIS INVENTION

The lubrication of two-stroke cycle internal combustion engines is provided by an oil-fuel mixture. In this situation, the combustion characteristics of the oil which acts as a lubricant is as important as the lubricating characteristics of the oil in maintaining proper performance of the engine. While mineral lubricating oils provide a suitable source of the oil for use in such engines, these oils have a tendency to form combustion products which agglomerate to form deposits within the engine.

These deposits tend to cause excessive engine wear as well as spark plug fouling, ring sticking, and other difficulties.

Detergents are commonly added to lubricant compositions to prevent the deposition of solid materials on engine surfaces which come in contact with the lubricant composition. Lubricant compositions containing the ashless detergent prepared in accordance with the present invention are particularly satisfactory for use in a 2-stroke cycle gasoline engines. Such engines are becoming increasingly common and are found in chain saws, lawn mowers, outboard marine engines, and small cars or motor scooters.

It has been unexpectedly found that a detergent additive of improved characteristics useful in 2-stroke cycle engine lubricants can be prepared by reacting approximately 3 moles of isostearic acid with approximately 1 mole of tetraethylenepentamine. The imidazolines present in the products of this reaction are thereupon hydrolyzed with water to form amide reaction products. It has been found that the condensation reaction of isostearic acid with tetraethylenepentamine results in imidazolines. Unexpectedly, it has been found that when only amides are present in a detergent additive prepared in the procedure of the instant invention, the resulting detergent additive has improved detergent properties in an engine lubricant over detergent additives prepared in a conventional procedure.

It has long been known that lubricant detergent additives can be prepared by the reaction of a fatty acid with an amine. U.S. Pat. Nos. 3,110,673 and 3,169,980 teach the preparation of a lubricant composition from a mixed fatty acid and a polyamine. The fatty acid is a mixture of from 5 to about 30 mole percent of straight chain fatty acid and from about 70 to about 95 mole percent of branched chain fatty acid. The fatty acids contain from about 12 to about 30 carbon atoms. The polyamine is of the structure $H_2N[R_1\text{-}N(R_2)]_nR_1NH_2$ wherein $R_1$ contains from 2 to 4 carbon atoms, $R_2$ is hydrogen or an acyl group and n is an integer of from 1 to 5. The procedure of '673 teaches the reaction mix of the fatty acid mixture and polyamine are reacted according to known methods at conventional temperature for the usual period of time required to amidify the amino groups of the polyalkylene polyamine. Temperatures are in the range of from 250° F. to 500° F. Means of removing water of condensation is employed. U.S. Pat. No. 3,251,853 teaches an oil-soluble nitrogen-containing compound useful in lubricating oil compositions especially suitable for 2-stroke cycle engines. The nitrogen-containing compound is prepared by reacting at a temperature above 100° C. a mixture comprising an amine selected from the group consisting of alkyl amines, aminoalkylamines and hydroxyalkyl amines with at least 0.5 equivalent of an acid producing compound of the structural formula RCOOH wherein R is a branched chain hydrocarbon radical having 14 to 20 saturated aliphatic carbon atoms in the principal chain and at least one lower acyclic pendant aliphatic group. The preferred relative proportions of the two reactants is one equivalent of the acid producing reactant to one to two equivalents of the amine. In some instances, as much as two equivalents of the acid producing reactant may be used for each equivalent of the amine. The unsaturated fatty acids from which the iso-aliphatic acids are obtained include oleic acid, lineoleic acid, linolenic acid or commercial fatty acid mixtures such as tall oil. The iso-aliphatic acid prepared from the above unsaturated acid is reacted with an amine, at a temperature preferably between 120° C. and 250° C. Water of reaction is removed. U.S. Pat. No. 3,405,064 teaches a lubricating oil composition containing a nitrogen-containing composition prepared by the method of U.S. Pat. No. 3,251,853.

Accordingly, in the prior art, there are teachings of the preparation of lubricant oil additives prepared from a reaction mixture of a fatty acid and an amine. However, there has been no recognition in the prior art that condensation of an isostearic acid with tetraethylene pentamine in a ratio of approximately 3 moles of acid to about 1 mole of amine, followed by hydrolysis of the resulting imidazoline groups to amides, resulted in an improved ashless detergent two-stroke cycle additive which maintains excellent engine cleanliness and has excellent low temperature stability.

SUMMARY OF THE INVENTION

An ashless two-stroke cycle additive is disclosed that maintains excellent engine cleanliness and has excellent low-temperature storage stability. The additive is prepared by condensing approximately 3 moles of isostearic acid with one mole of tetraethylenepentamine. Water is added to the reaction to convert imidazoline groups to amides. The amide form has superior engine cleanliness characteristics.

DETAILS OF THE INVENTION

It has now been discovered that an ashless two-stroke cycle lubricating oil additive with improved properties can be prepared by condensing about 3 moles of isostearic acid with about 1 mole of tetraethylenepentamine. Water is then added to the reaction to convert imidazoline groups to amides.

The above process can be carried out by mixing the two reactants and heating the mixture to a temperature of at least 100° C. The reaction which characterizes the above process before hydrolysis is believed to result predominantly in imidazoline group. As exemplified in Example III, the presence of imidazoline groups inhibits the cleanliness characteristics of the material when added to a motor oil lubricant as a detergent additive.

The temperature at which the process is carried out depends primarily upon the nature of the reactants and the desired product of imidazolines. In general, the reaction temperature should be at least 100° C., preferably between 120° C. and 250° C. A still higher temperature can be used provided it does not exceed the decomposition temperatures of the reactants.

The relative proportions of the two reactants depend upon the number of the nitrogen atoms in the amine reactant. The number of nitrogen atoms in the amine reactant is critical, as the greater number of nitrogen atoms increases the number of imidazoline groups which can then be converted to amide groups. The ethylene amines useful in the instant invention accordingly have at least three nitrogen atoms and preferably five nitrogen atoms as pentamines. Hexamines, heptamines and octamines are useful. Mixtures containing from three to eight amines groups or more can also be used. Specific examples of such ethylene amines are diethylenetriamine, tetraethylenepentamine, triethylenetetramine, hexaethyleneheptamine, heptaethyleneoctamine, and the like, and mixtures thereof. Although quite satisfactory products are obtained from pure ethylene amines, quite satisfactory products are also obtained from mixtures of amines, especially those containing the higher numbered amines.

The iso-aliphatic acids useful in the invented process comprise branched chain fatty acids having from 16 to 20 carbon atoms. For the purposes of the present invention, Emersol 871 Isostearic Acid or Emersol 875 Isostearic Acid, made by Emery Industries, Cincinnati, Ohio, can be used. Emersol 871 Isostearic Acid is preferred because of easy availability in quantity. An alternative source of an iso-aliphatic acid is Century 1105 Isostearic Acid or Century 1110 Isostearic Acid, available from Union Camp Corporation, Chemical Div., Jacksonville, Fla.

The iso-aliphatic acids can be in a purified form consisting essentially of iso-alphatic acids and also a mixture of iso-aliphatic and aliphatic acids of from 16 to 20 carbon atoms. However, the presence of aliphatic acids in the mixture will cause low temperature instability.

The base oil in the lubricant composition of the invention is anyone of a wide variety of oils of lubricating viscosity. Thus, the base oil can be a refined-paraffin type base oil such as a refined Pennsylvania or other paraffin base oil, a refined naphthenic base oil or a synthetic hydrocarbon or non-hydrocarbon oil of lubricating viscosity. The base oil can also be a mixture of mineral and synthetic oils. For present purposes, the mineral lubricating oils are preferred since they are presently in more general use in 2-stroke cycle engines.

Lubricant compositions within the scope of the present invention can also contain still other additives of conventional types, such as pour point depressants, oiliness and extreme pressure agents, antioxidants, dyes, blooming agents and the like.

In summary, the instant invented composition comprises a lubricating oil composition comprising a lubricating oil and a detergent additive wherein said detergent additive is the hydrolyzed reaction product of an aliphatic carboxylic acid of 16 to 20 carbon atoms and a polyamine of at least 3 amine groups. The lubricating oil composition can also comprise the hydrolyzed reaction product of a mixture of straight chain carboxylic acids and branched chain carboxylic acids of 16 to 20 carbon atoms with a polyamine of at least 3 amine groups. Low temperature stability of the lubricating oil composition is affected by use of the mixture of straight chain carboxylic acids and branched chain carboxylic acids. In particular, the instant invention comprises a lubricating oil composition wherein said composition comprised a branched chain carboxylic acid, preferably isostearic acid, and the said polyamine is tetraethylenepentamine.

The following examples are illustrative of typical methods for preparing the polyamide and of lubricant compositions containing it.

EXAMPLE I

A 3-neck, round bottom, 2 liter flask equipped with a stirrer, thermometer with temperature control device, distillation tube and tray, side arm and separating funnel was used. The flask was charged with 227.18 g (1.2 moles) of tetraethylenepentamine (TEPA). A slow nitrogen sparge was started and the TEPA heated to 250° F. To the TEPA was slowly added 1067.98 g (3.6 moles) Emersol 871 Isostearic Acid. After complete addition the temperature was raised to 300° F. for 1 hour during with 65 ml of water were removed. The reaction was then raised to 400° F. for 1 hour and then lowered to 300° F. for 4.5 hours.

The reaction mixture was cooled to 90° C. and 100 ml of distilled water was added and the mixture stirred for 2 hours with a nitrogen blanket. The reaction mixture was then raised to 100° C. and excess water was removed via a nitrogen sparge.

The infrared absorption spectrum of the product prepared with hydrolysis of the imidazoline units with water at 100° C. indicated that only amide units were present. Evidence of the absence of the imidazoline units was given by the absence of an absorption at 1620 $cm^{-1}$. Additionally, there was an increase and a sharpening of the absorption band at 1550 $cm^{-1}$ in the hydrolyzed material. The 1550 $cm^{-1}$ band is generally recognized as an "Amide II" band and is indicative of secondary amides. Secondary amides are formed by the hydrolysis of imidazolines. (L. J. Bellamy, *The Infrared Spectra of Complex Molecules,* Chapman and Hall, London 3rd e., p. 223).

EXAMPLE II

The procedure of Example I was repeated but the hydrolysis with water at 100° C. was omitted. The infrared absorption spectrum of the product prepared without hydrolysis indicated that imidozaline units were present. The unhydrolyzed material showed an absorption at 1620 $cm^{-1}$ indicating imidazoline units were present.

EXAMPLE III

In this example, engine test runs were made of the products of the procedures of Examples I and II. The test used was the "Two-Cycle Air Cooled Engine Lubricant Evaluation Y-350M Procedure." This test uses a Yamaha RD-350 B air cooled, two cylinder, two-cycle engine. A separate oil is evaluated in each cylinder allowing a direct comparison between a standard, i.e., reference oil, and test oil. The test procedure requires a 20-hour test period which encompasses two phases. Phase one requires running the engine at 6,000 RPM under load for 25 minutes, and phase two, 2,000 RPM under no load for 5 minutes. The cycle is repeated five times and then the engine is shut down for one hour. The above procedure is then repeated eight times for a total of 20 hours.

The average piston rating and the ring sticking rating are the significant ratings in this test. The higher the numerical rating (10 is maximum) the better the cleanliness performance of the additive. Except for the piston rings; the rating are for cleanliness. The piston rings are rated for degree of sticking. A rating of 10.0 indicates a completely free piston ring.

The lubricating oil used in the tests was a formulation containing 89.8 (wt) % refined paraffin type base oil and 10.2 (wt) % ashless two-stroke cycle additive. The ashless two-stroke cycle additive in the reference oil was a commercially-available dispersant Oronite 340D, additive available from Chevron Chemical Company. Oronite Additives Div., San Francisco, Calif. Citgo 93734 reference oil, from Citgo Petroleum Corporation, Tulsa, Okla., used as an industry standard in two-stroke cycle engine test to measure engine cleanliness, was used in Test 34, cylinder 2, as a standard.

Table 1 lists the results of the engine tests.

TABLE 1

Yamaha Two-Stroke Cycle Engine Test Results

| Test No. | 34 | | 35 | | 38 | |
|---|---|---|---|---|---|---|
| Cylinder No. | 1 | 2 | 1 | 2 | 1 | 2 |
| Formulation (wt %) | | | | | | |
| 2-Stroke Cycle Base oil (a) | 90 | | 90 | 90 | 90 | 90 |
| Citgo 93734 (b) | | 100 | | | | |
| Additive | | | | | | |
| Oronite OLOA 340D (c) | | | | 10 | 10 | |
| Ex. 1 - Hydrolyzed | | | 10 | | | 10 |
| Ex. 2 - Non-Hydrolyzed | 10 | | | | | |
| | 100 | 100[a] | 100[d] | 100[d] | 100 | 100 |
| Results | | | | | | |
| Piston Skirt, avg. | 6.1 | 7.2 | 6.3 | 7.0 | 7.8 | 9.1 |
| Ring Land | 1.2 | 3.2 | 2.0 | 2.9 | 2.3 | 5.3 |
| Piston Top | 9.1 | 9.3 | 9.3 | 9.4 | 9.4 | 9.2 |
| Cyl. Head | 8.7 | 7.9 | 7.8 | 7.8 | 7.8 | 8.0 |
| Exh. Port | 9.8 | 9.8 | 9.8 | 9.8 | 9.8 | 9.8 |
| Piston - Undercrown | 1.0 | 2.8 | 1.3 | 1.8 | 1.7 | 6.3 |
| Ring Sticking | | | | | | |
| Top | 7.7 | 10.0 | 10.0 | 10.0 | 10.0 | 10.0 |
| Bottom | 5.0 | 7.4 | 6.4 | 8.0 | 7.0 | 8.4 |

(a) Refined paraffin type base oil.
(b) Citgo 93734 Reference Oil.
(c) Oronite OLOA 340D - Ashless dispersant for gasoline two-cycle engine oil.

Test 34 in Table 1 is a comparison of an oil formulated with the non-hydrolyzed, imidazoline product with a reference oil. In this test, the reference oil had a piston skirt rating of 7.2 while the test oil containing the imidazoline had a piston rating of 6.1, a difference of 1.1 rating units. The reference additive in test 34 had a top ring rating of 10.0 and a bottom ring rating of 7.4 while the test of the imidazoline additive had a top ring rating of 7.7 and a bottom ring rating of 5.0 indicating significantly poorer results for the test additive.

In test 35, which is a comparison of the hydrolyzed product to a reference additive, the difference in piston skirt ratings is only 0.7 rating units and, significantly, the ring sticking ratings have been significantly improved. This amide additive (hydrolysis product) had a top ring rating of 10.0, the same as reference oil, and a bottom ring rating of 6:4.

The improved performance of the hydrolyzed additive is shown further by the result of test 38, Table 1. In the test the performance of the oil formulated with the hydrolyzed additive exceeded the performance of the reference oil in piston rating, ring sticking and in all other ratings except the "piston top" rating.

EXAMPLE IV

The engine test procedure of Example III was repeated. The test used was the "Two-Cycle Air Cooled Engine Lubricant Evaluation Y-35M Procedure." The test additive used was prepared from a mixture of 10 (wt) % stearic acid and 90 (wt) % isostearic acid (Emersol 871 Isostearic Acid). The test additive was prepared in the procedure of Example I using a 3:1 mole ratio of acid to tetraethylenepentamine (TEPA). After the condensation reaction, the mixed acid-amine condensation product was hydrolyzed. The reference additive was Oronite 340D. Results are in Table II.

TABLE II

Yamaha Two-Stroke Engine Test Results

| Test No. | 37 | | 39 | |
|---|---|---|---|---|
| Cylinder No. | 1 | 2 | 1 | 2 |
| Formulation (wt %) | | | | |
| 2-Stroke Cycle Base Oil (a) | 90 | 90 | 90 | 90 |
| Additive | | | | |
| Oronite 340D | 10 | | | 10 |
| TEPA-Mixed Acids (Hydrolyzed) | | 10 | 10 | |
| | 100 | 100 | 100 | 100 |
| Results | | | | |
| Piston Skirt, avg. | 7.5 | 9.2 | 7.2 | 7.6 |
| Ring Land | 1.9 | 3.7 | 1.4 | 2.0 |
| Piston Top | 9.3 | 9.2 | 9.3 | 9.2 |
| Cyl. Head | 7.8 | 7.8 | 7.8 | 7.8 |
| Exh. Part | 9.8 | 9.8 | 9.8 | 9.8 |
| Piston Undercrown | 1.4 | 2.7 | 2.3 | 1.4 |
| Ring Sticking | | | | |
| Top | 10.0 | 10.0 | 10.0 | 10.0 |
| Bottom | 6.5 | 8.2 | 7.9 | 7.7 |

(a) Refined paraffin type base oil.

Test 37 and 39 are side-by-side comparisons of an lubricating oil formulated with a hydrolyzed mixture of stearic and isostearic acids condensed with tetraethylenepentamine and a comercially-available additive. The engine test results using the hydrolyzed mixture of isostearic and stearic acids condensed with TEPA are comparable to the engine test results of the hydrolyzed product of isostearic acid condensed with TEPA, Engine Test Nos. 35 and 38 of Example III.

EXAMPLE V

Low temperature stability of lubricating oils prepared with the additive of this instant invention was compared with non-hydrolyzed additives containing stearic acid and isostearic acid. Upon storage for 24 hours at 0° C., the lubricating oil containing 100% isostearic acid remained clear, whereas formulations containing stearic acid developed an unacceptable haze. The data are in Table II.

TABLE 3

| Low-Temperature Storage Stability Test | |
|---|---|
| Additive Composition (mole %)[a] | Low-Temperature Storage Stability[b] |
| 10% Stearic/90% Isostearic, amide | hazy |
| 7% Stearic/93% Isostearic, amide | hazy |
| 5% Stearic/95% Isostearic, amide | hazy |
| 100% Isostearic, amide | clear |
| 100% Isostearic, imidazoline | clear |
| 10% Stearic, 90% Isostearic, imidazoline | hazy |

[a]Additives were prepared by reacting 3 moles of either isostearic acid or a isostearic/stearic acid mixture with 1 mole of tetraethylenepentamine according to the procedures in Example I and II. The designation "amide" indicates hydrolysis. The designation "imidazoline" indicates no hydrolysis.
[b]The storage stability was determined by visually rating two-stroke oils formulated with the respective additive. The formulation given below was used. The temperature of the storage room was 0° C. The oils were stored for ≧1 day.
Formulation: 89.8 (wt) % refined paraffin type base oil and additive 10.2 (wt) %.

What is claimed is:

1. A lubricating oil composition comprising a lubricating oil and a detergent additive wherein said detergent additive is the hydrolyzed reaction product of an aliphatic branched chain carboxylic acid of 16 to 20 carbon atoms and a polyamine of at least 3 amine groups wherein said carboxylic acid and said polyamine are reacted at a temperature of from about 100° C. to about 250° C. to form a reaction product, said reaction product is cooled and hydrolyzed by addition of water at a temperature of up to 100° C. where said hydrolyzed reaction product is essentially free of imidazoline units.

2. The lubricating oil composition of claim 1 wherein said aliphatic carboxylic acid consists essentially of branched chain carboxylic acids.

3. The lubricating oil composition of claim 1 wherein said aliphatic carboxylic acid is isostearic acid.

4. The lubricating oil composition of claim 1 wherein said polyamine is a mixture of polyamines containing from 3 to 8 amine groups.

5. The lubricating oil composition of claim 1 wherein said polyamine is tetraethylenepentamine.

6. The lubricating oil composition of claim 1 where said aliphatic carboxylic acid is isostearic acid and said polyamine is tetraethylenepentamine.

* * * * *